US006863581B2

(12) United States Patent
Anderson

(10) Patent No.: US 6,863,581 B2
(45) Date of Patent: Mar. 8, 2005

(54) TROLLING MOTOR

(76) Inventor: Carl E. Anderson, 1011 Capouse Ave., Scranton, PA (US) 18509

( * ) Notice: Subject to any disclaimer, the term of this patent is extended or adjusted under 35 U.S.C. 154(b) by 0 days.

(21) Appl. No.: 10/107,666

(22) Filed: Mar. 27, 2002

(65) Prior Publication Data

US 2002/0142680 A1 Oct. 3, 2002

Related U.S. Application Data

(60) Provisional application No. 60/278,946, filed on Mar. 27, 2001.

(51) Int. Cl.[7] ..... B63H 5/20

(52) U.S. Cl. ..... 440/53; 440/6; 440/63; 248/642

(58) Field of Search ..... 440/6, 53, 61 R, 440/61 T, 61 D, 61 E, 61 F, 62–64; 248/640–643

(56) References Cited

U.S. PATENT DOCUMENTS

| | | | | | |
|---|---|---|---|---|---|
| 2,668,679 | A | * | 2/1954 | Harneit | 248/641 |
| 2,713,843 | A | * | 7/1955 | Staley | 440/63 |
| 2,757,888 | A | * | 8/1956 | Branstrator | 248/641 |
| 2,782,744 | A | * | 2/1957 | Staley | 440/63 |
| 2,809,605 | A | * | 10/1957 | Russell | 440/61 R |
| 2,822,999 | A | * | 2/1958 | Tromanhauser | 248/642 |
| 2,859,929 | A | * | 11/1958 | Woods | 248/642 |
| 2,901,194 | A | * | 8/1959 | Shontz | 248/642 |
| 2,905,132 | A | * | 9/1959 | Lewis et al. | 440/63 |
| 2,916,009 | A | * | 12/1959 | Baird | 440/55 |
| 2,928,630 | A | * | 3/1960 | Wisman | 248/641 |
| 2,928,631 | A | * | 3/1960 | Hartman | 248/641 |
| 2,954,192 | A | * | 9/1960 | Baird | 248/641 |
| 2,972,976 | A | * | 2/1961 | Smith | 440/63 |
| 3,006,311 | A | * | 10/1961 | Wynne et al. | 440/63 |
| 3,032,304 | A | * | 5/1962 | Machlan | 248/641 |
| 3,039,724 | A | * | 6/1962 | Herreman | 248/642 |
| 3,075,490 | A | * | 1/1963 | Lang | 440/53 |
| 3,139,853 | A | * | 7/1964 | McCarthy et al. | 440/66 |
| 3,426,723 | A | * | 2/1969 | Specht | 440/63 |
| 3,596,625 | A | * | 8/1971 | Guenther | 440/6 |
| 3,674,228 | A | * | 7/1972 | Horton | 248/642 |
| 3,724,790 | A | * | 4/1973 | Harris et al. | 248/642 |
| 3,756,186 | A | * | 9/1973 | Nordling | 440/63 |
| 3,765,369 | A | * | 10/1973 | Henning | 440/55 |
| 3,877,667 | A | * | 4/1975 | Monckton | 248/641 |
| 3,881,443 | A | * | 5/1975 | Hamp | 440/1 |
| 4,013,249 | A | * | 3/1977 | Meyer et al. | 248/642 |
| 4,168,818 | A | * | 9/1979 | Ellis | 248/640 |
| 4,223,625 | A | * | 9/1980 | Puretic | 114/147 |
| 4,304,556 | A | * | 12/1981 | Wilson | 440/63 |
| 4,498,872 | A | * | 2/1985 | Shonley et al. | 440/63 |
| 4,573,930 | A | * | 3/1986 | Queen | 440/56 |
| 4,824,067 | A | * | 4/1989 | O'Brien | 248/642 |
| 4,890,811 | A | * | 1/1990 | Ehni | 248/642 |
| 5,188,549 | A | * | 2/1993 | Kozubski | 440/63 |
| 5,350,327 | A | * | 9/1994 | Self et al. | 440/66 |
| 5,522,578 | A | * | 6/1996 | Mayfield | 248/642 |
| 5,704,308 | A | * | 1/1998 | Anderson | 114/285 |
| 5,842,895 | A | * | 12/1998 | DeVito, Jr. | 440/6 |
| 5,878,686 | A | * | 3/1999 | Anderson | 114/285 |
| 6,413,126 | B1 | * | 7/2002 | Johnson | 440/38 |
| 6,520,813 | B1 | * | 2/2003 | DeVito, Jr. | 440/6 |

FOREIGN PATENT DOCUMENTS

| | | | | |
|---|---|---|---|---|
| DE | 2413084 | A | * 10/1975 | 440/900 |

* cited by examiner

*Primary Examiner*—S. Joseph Morano
*Assistant Examiner*—Ajay Vasudeva
(74) *Attorney, Agent, or Firm*—Katten Muchin Zavis Rosenman

(57) ABSTRACT

A propulsion apparatus includes a motor attached to a bracket assembly that is attached to and pivots from the transom of a boat. A positioning handle is attached at a distal end of the bracket assembly, and may be held at one or more positions in a retaining bracket attached to the deck of the boat near the transom. The motor is positioned substantially rearward from and above a bottom edge of the transom in order to remain operative when the boat bottoms. A preferred embodiment includes a propulsion apparatus mounted at each of two lateral ends of the transom.

24 Claims, 16 Drawing Sheets

TROLLING MOTOR

CROSS-REFERENCE TO RELATED APPLICATION

The present application claims priority under 35 U.S.C. § 119(e) from U.S. Ser. No. 60/278,946, filed on Mar. 27, 2001. U.S. Ser. No. 60/278,946 was filed Mar. 27, 2001 by an inventor common to the present application, and is hereby incorporated by reference.

FIELD OF THE INVENTION

This invention relates generally to a propulsion and maneuvering apparatus. More particularly, the invention relates to a trolling motor affixed to a boat for particular use in shallow water conditions.

BACKGROUND OF THE INVENTION

Many boating people have experienced hitting bottom, and even getting stuck on the water from running aground. Great care must always be taken when negotiating shallow waters. Using conventional propulsion systems (such as outboard motors) in shallow waters can be problematic, as these systems can effectively add to the draft of the boat so that opportunities for running aground are heightened.

Trolling motors are generally utilized in low water, and typically when the main engines are off. These motors can provide quick and precise bursts of speed when fishing, so that the fishermen can easily and quickly follow a fish. It has been known to provide such trolling motors on the trim tabs extending from the stem of the boat. One such type of trolling motor is described in U.S. Pat. No. 5,704,308, issued to Anderson on Jan. 6, 1998, and incorporated by reference herein. The '308 patent discloses a system for propulsion in shallow waters employing a trolling motor attached to an upper surface of a conventional trim tab or afterplane. Trim tabs are commonly found on motorboats as long as sixty feet in length as a means for avoiding unnecessary upward travel of the bow during hard acceleration.

Currently, a number of types of trim tab motors are being manufactured. A typical unit, manufactured by Lenco Marine Inc. of Stuart, Fla., requires a minimum of 18 inches of water to work properly. Alternatively, Minn Kota of Mankato, Minn. offers conventional trolling motors having bendable shafts made of composite materials that are designed to flex when hitting bottom. However, both types of systems are often ineffective when called upon to propel a boat after it has hit bottom.

One reason that such systems have proved ineffective is that it is difficult to generate sufficient thrust when motors and propellers are located in close proximity to the rear transom of a boat. Water directly behind a moving boat is usually aerated, which means that it includes air bubbles. Propellers operating in water that is aerated are substantially less efficient and generate substantially less thrust.

Accordingly, it would be desirable to have an efficient propulsion mechanism mountable at the rear of a boat that provides sufficient thrust to propel a boat even when it has bottomed.

SUMMARY OF THE INVENTION

The present invention provides for an easy lift, efficient propulsion apparatus that can be manually positioned from inside a boat. The apparatus comprises a propulsion motor that is fixedly attached to a primary bracket assembly, which is pivotally attached at a proximal end to the transom of the boat. A retaining bracket is attached to the deck of the boat near the transom and positioned to receive a positioning handle. The positioning handle is pivotally attached at a distal end of the primary bracket, and may be adjustably and securely located in the retaining bracket in order to achieve a desired operating position for the propulsion motor.

In a preferred embodiment, the propulsion motors are trolling motors mounted at least 24 inches distal from the boat's transom. In this position, the motor will typically be positioned in water having a limited number of air bubbles. It should be noted that optimal positioning of the trolling motor away from the boat's transom may vary with the configuration of the boat.

In a second preferred embodiment, two propulsion apparatus are each positioned near the bottom and at opposing lateral edges of the transom. The bottom transom edge for most boats is higher at the lateral edges of the transom than at the center. Water traveling over these lateral edges typically has a more limited number of air bubbles. This positioning provides an efficient propulsion conduit for the propulsion motors. This conduit is generally maintained under speed, as water tends to rise and bulge somewhat behind a moving boat. As trolling motors tend to propel vessels at speeds below those required for the planing (i.e., where the bottom surface of the boat hull to rises to be at or above the surface of the water), the arrangement keeps the propellers at an effective operating position.

The two propulsion apparatus are also configured for steering and otherwise maneuvering the boat. In the present embodiment, the motors do not swivel, but rather depend on individual thrust and/or propeller rotational direction to go forward, backward and to turn. This concept is also employed, for example, by conventional power boats having twin inboard or outboard engines.

BRIEF DESCRIPTION OF THE DRAWINGS

A more complete understanding of the invention may be obtained by reading the following description of specific illustrative embodiments of the invention in conjunction with the appended drawing in which.

In the various figures, like reference numerals designate like or similar elements of the invention.

DETAILED DESCRIPTION OF THE PREFERRED EMBODIMENTS

The following detailed description includes a description of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
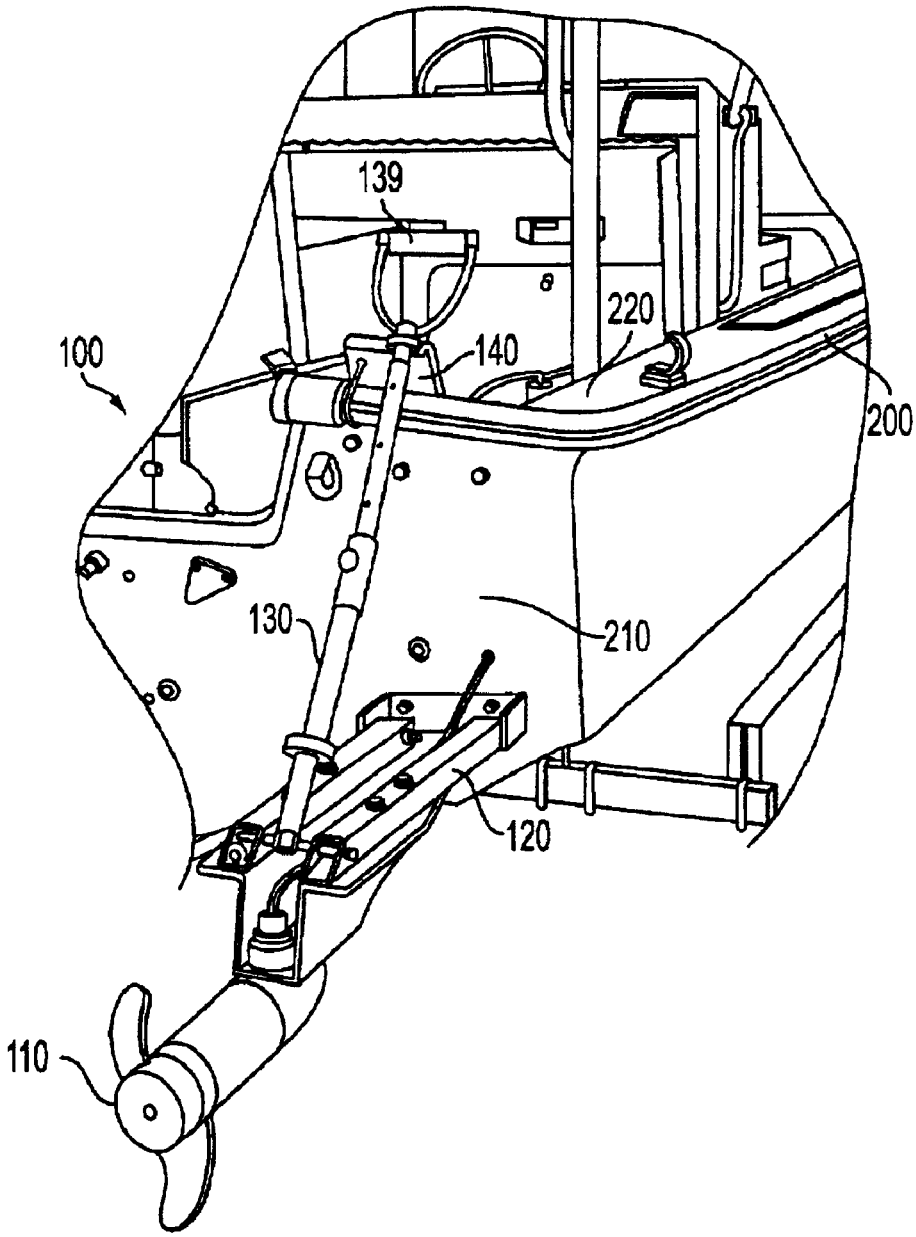
FIG. 1 provides a perspective view of a first illustrative embodiment of the propulsion apparatus as viewed from a right rear side of the system.

In an illustrative embodiment of the present invention, as shown in FIG. 1, a propulsion apparatus 100 includes a standard steering motor 110 which is pivotally attached to the transom 210 of a boat 200 by means of a bracket assembly 120. The motor may comprise one of a number of conventional electric trolling motors, for example, as manufactured by Minn Kota of Mankato, Minn.

A positioning handle 130 is secured by a retaining bracket 140 that is fixedly attached to a deck 220 near the transom 210 of the boat 200. The positioning handle 130 is used to pivotally position the motor into upward and downward positions as desired. A locking arrangement associated with the retaining bracket 140 on the top edge of the boat can be used to secure the motor in an upright position. Several embodiments of the locking arrangement are further described herein.

Figure 2A:
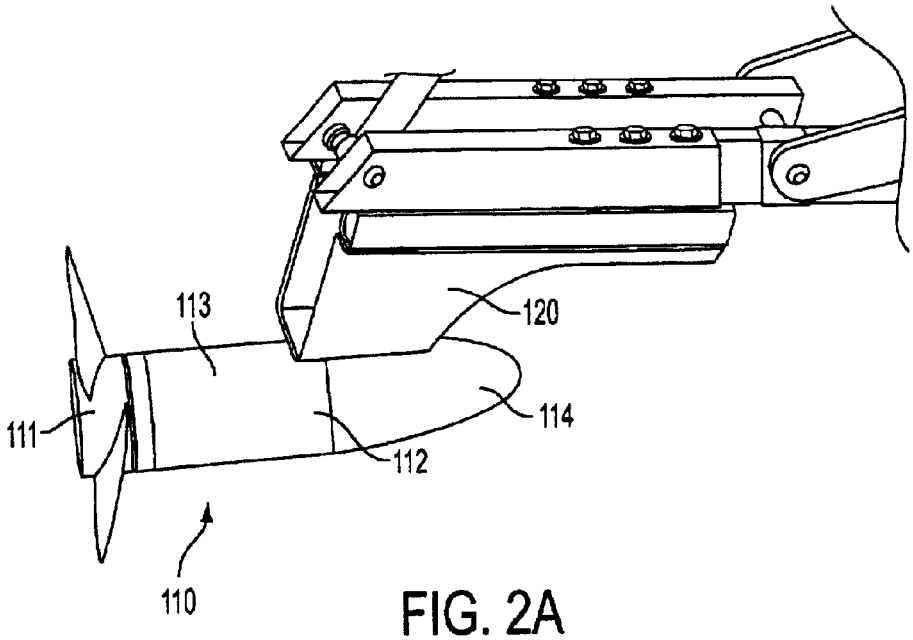
FIG. 2A provides a side view of the embodiment of FIG. 1.

As shown in FIG. 2A, the motor 110 of the present invention comprises a propeller 111 at a distal end extending from an elongated motor casing 112, the reel 113 of which is depended from a housing 114 from which wires from the motor extend. The housing is secured to bracket assembly 120 also attached to the transom 210. Propeller 111 is preferably positioned at least 24 inches away from transom 210 of FIG. 1 in order to be positioned in "clean" water (i.e., having a limited number of air pockets or bubbles) for efficient operation.

Figure 2B:
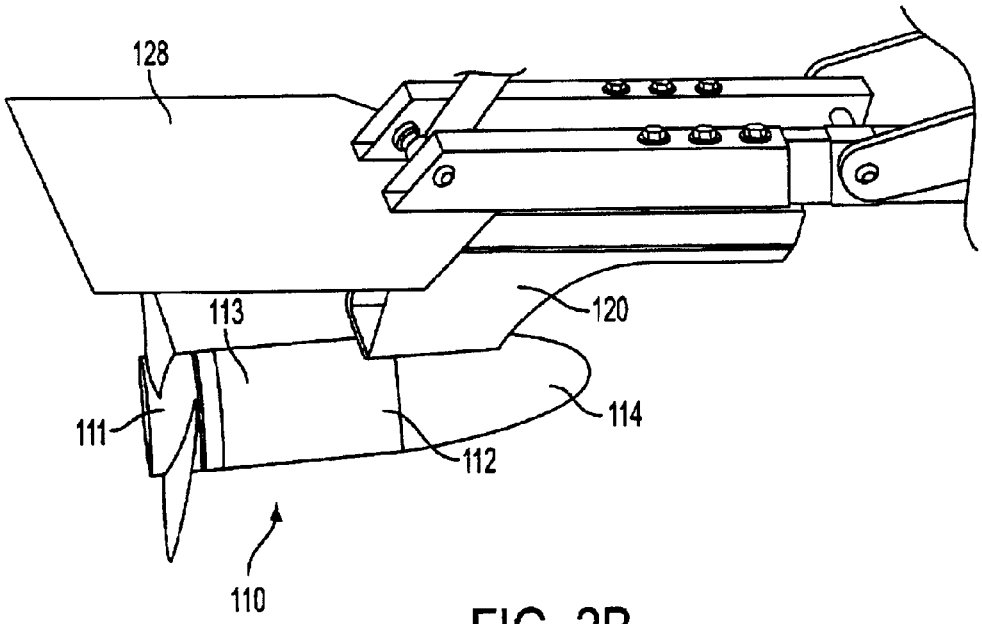
FIG. 2B provides a side view of a second illustrative embodiment of the invention.

An alternate and preferred embodiment of the present invention is illustrated by FIG. 2B, in which deflection plate 128 is attached to bracket assembly 120, in position to cover at least a vertical projection of a volume traced by propeller 111 through its rotation. The addition of deflection plate 128 has been experimentally found to improve the in-water boat speed generated by motor 110, and to muffle the in-water sound generated by associated surface turbulence. This sound muffling may help the operator, for example, to move the boat 200 of FIG. 1 in closer proximity to fish in the water without startling the fish.

Figure 3:
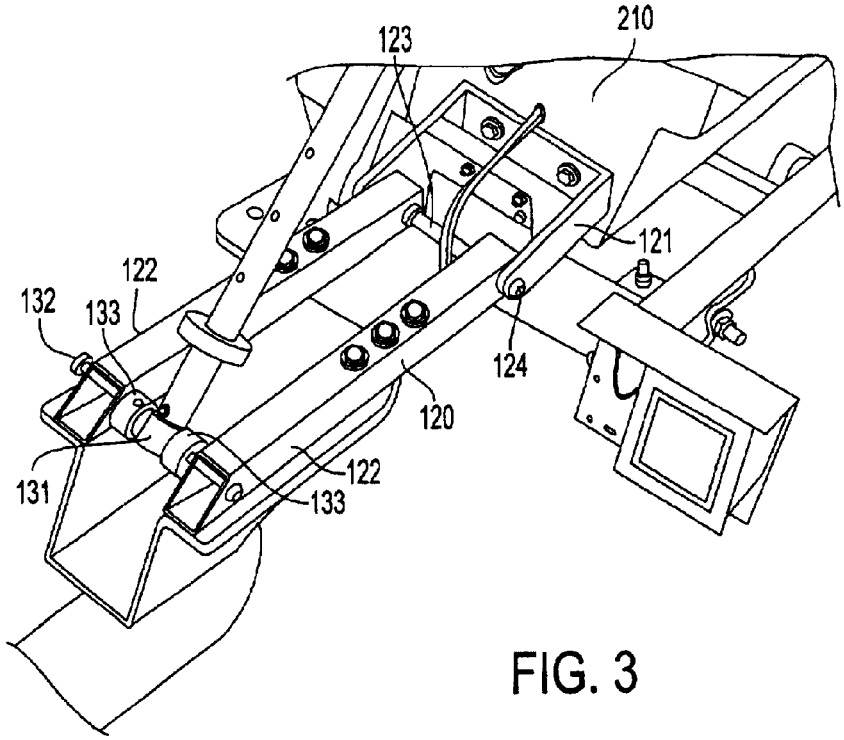
FIG. 3 further illustrates the embodiment of FIG. 1, with emphasis on a primary bracket assembly of the system.

As shown in FIG. 3, the bracket assembly 120 holding motor 110 is secured to the transom 210 by means of a clamp 121. The clamp 121 is pivotally coupled to lateral members 122 by axle 124. A desired positioning of lateral members 122 is maintained by a spacer 123 that carries the axle 124.

Figure 4:
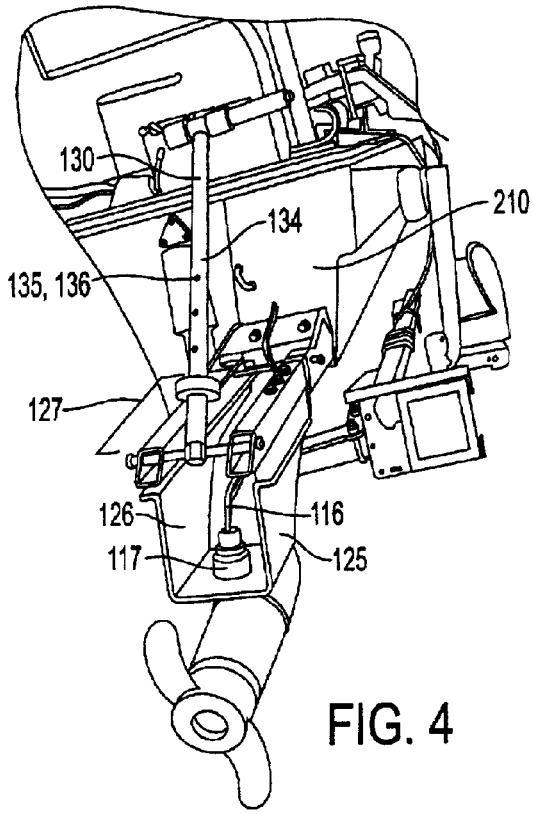
FIG. 4 further illustrates the embodiment of FIG. 1, with emphasis on routing of power and control wires associated with the system.
Figure 5:
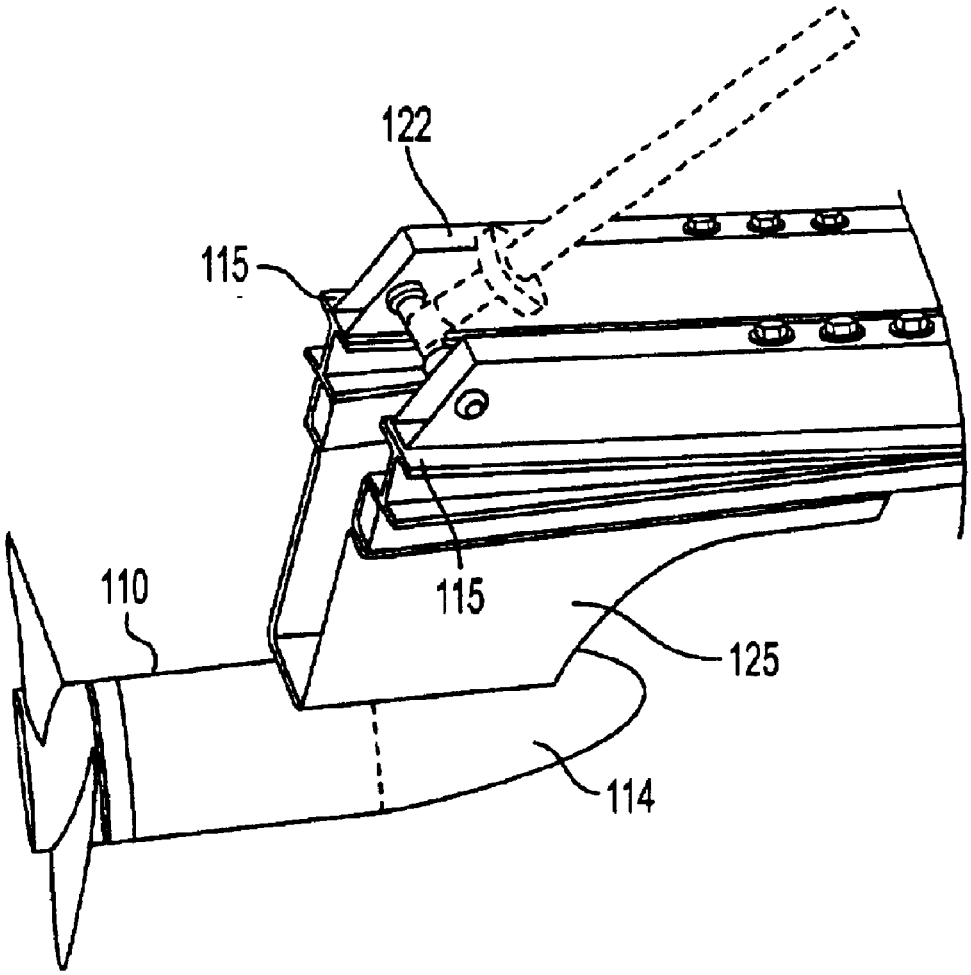
FIG. 5 illustrates a shim used for altering the angular position of a motor used in the system.

As illustrated in FIG. 4, bridge piece 125 fixedly couples motor 110 to lateral members 122. Bridge piece 125 has a u-shaped cross-section 126, the height of which may increase or decrease over a longitudinal distance 127 in order to cause motor 110 to be positioned at a desired operating angle with respect to the transom 210. Additionally, shims 115 (shown in FIG. 5) may be inserted between bridge piece 125 and lateral members 122 to further adjust operating position. Shims 115 are particularly useful for positioning motor 110 such that propeller 111 faces slightly downward at the rear of propulsion system 100. It should be understood that the present invention contemplates a full range of angular positions for motor 110 in support of a variety of applications served by the propulsion system 100.

Figure 12:
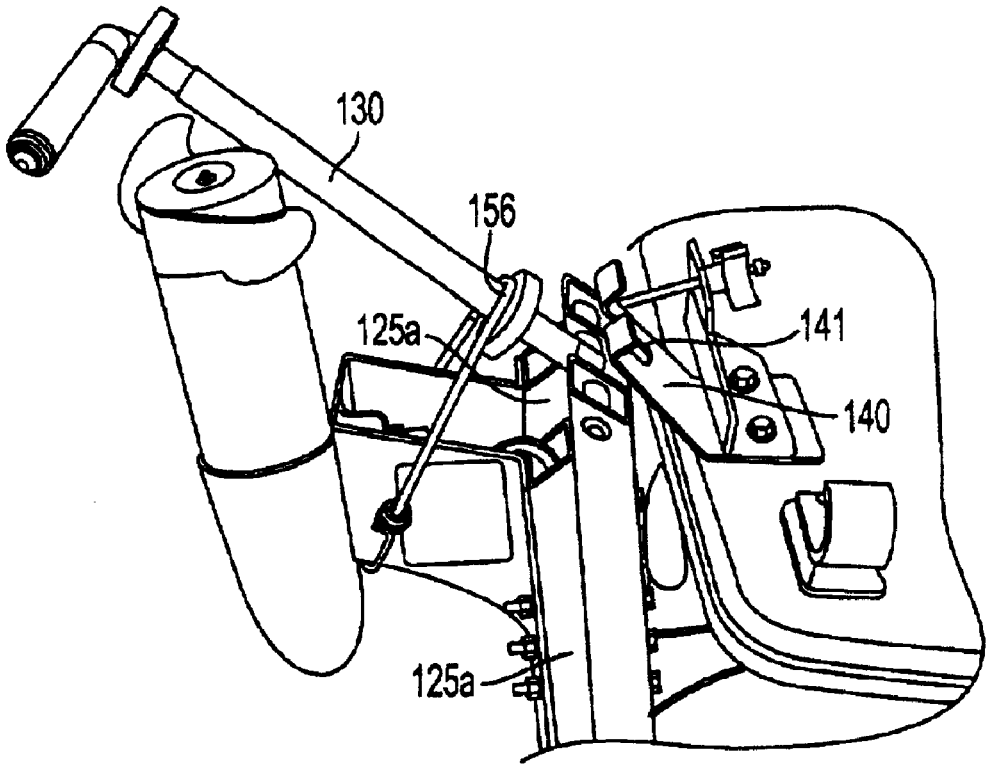

As further shown in FIG. 4, wires 116 extend upwardly from the motor 110 through a connector 117 that is fixedly coupled to bridge piece 125. Cross-section 126 defines a channel through which wires 116 are directed rearward through transom 210 to be coupled to a power source (not shown) and to a motor control unit 300, which will described further herein. As shown in FIG. 12, bridge piece 125 may optionally incorporate spacers 125*a* to provide an enclosed passage for routing wires 116 from the motor 110 to the transom 210.

Figure 6:
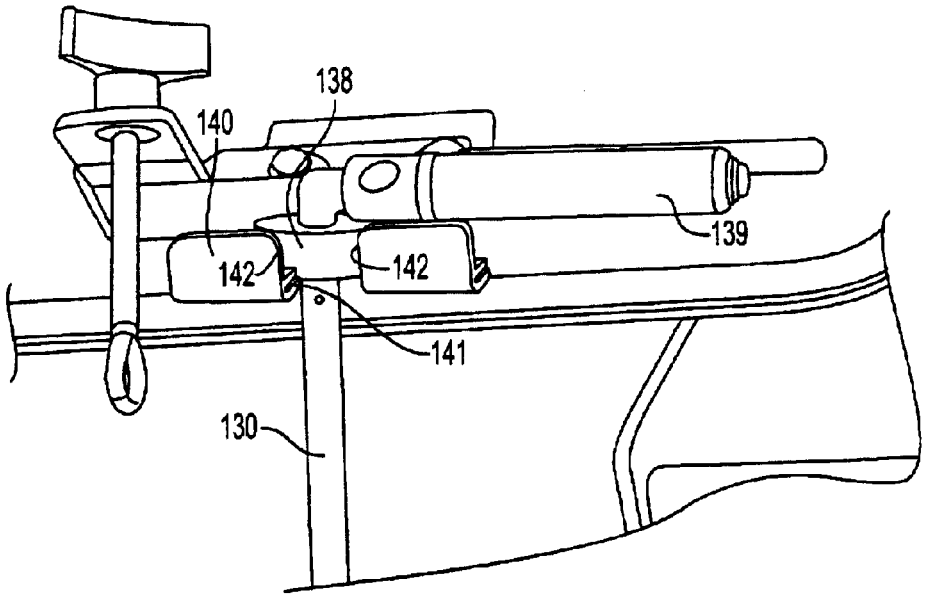
FIG. 6 shows a positioning handle of the system and associated retaining bracket.

Returning to FIG. 3, coupled to a distal end of the lateral members 122 is a pivot end 131 of the positioning handle 130. Pivot end 131 is pivotally coupled to lateral members 122 by axle 132 and bushings 133. At an opposing end, as shown in FIG. 6, positioning handle 130 is retained in a retaining bracket 140. A retaining disk 138 is fixedly attached to positioning handle 130, and positioning handle 130 is placed through a groove 141 in retaining bracket 140 so that surfaces 142 (partially obscured) of retaining bracket 140 support disk 138 and positioning handle 130. Alternatively, grip 139 may be positioned by groove 141 and held by one or more of the surfaces 142. It should be noted that a full variety of conventional configurations of grip 139 are contemplated by the present invention (for example, as alternatively illustrated in FIGS. 1 and 7).

As shown in FIG. 4, positioning handle 130 may include an inner rod (not shown) and an outer tube 134, the assembly of which telescopes and is fixedly positioned by means of apertures 135 in outer tube 134 that adjustably mate with spring detent or movable pin 136 which is also secured by the inner rod. Thus, positioning handle 130 may be telescopically extended or shortened to accommodate varying water conditions and motor angles.

Of course, other means may be used to vary the effective length of positioning handle 130. For example, and as shown in FIG. 7, positioning handle 130 may be a non-telescoping member configured with fixedly mounted pins 137, which may be selectively positioned in and retained by retaining bracket 140 to obtain a desired positioning for motor 110.

Figure 7:
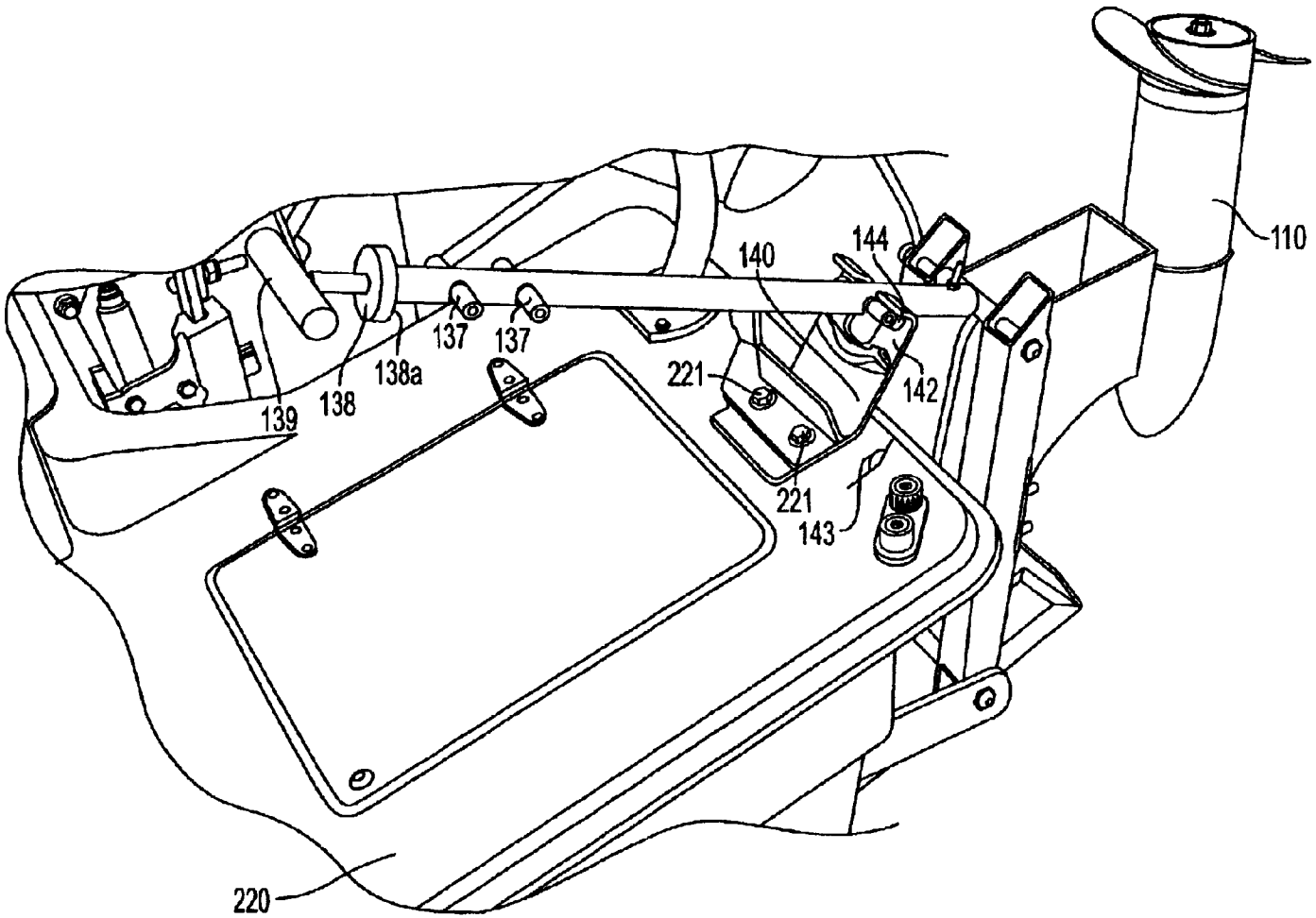
FIG. 7 provides a perspective view of a third embodiment of the system as viewed from a top, frontward position.

As shown in FIG. 7, retaining bracket 140 is secured to the deck 220 of the boat 200, for example, by bolts 221. Surfaces 142 of retaining bracket 140 are positioned at an angle 143 with respect to deck 220 such that a surface 138*a* of disk 138 can make substantially parallel contact as it is supported by surfaces 142. Surfaces 142 also optionally incorporate grooves 144 to effectively retain pins 137.

Referring back to FIG. 1, which illustrates the present invention configured in an operating position, it can be seen that bracket assembly 120, positioning handle 130 and transom 210 define an approximately triangular geometry. The geometry (in part as defined by angle 143 as illustrated in FIG. 7) is preferably selected such that an angle formed between a longitudinal axis through positioning handle 130 and a longitudinal axis through either of the lateral members 122 is approximately 45 degrees. It has been found that this particular angular arrangement permits the easiest ability to pull up the motor with the least amount of exertion.

Figure 8:
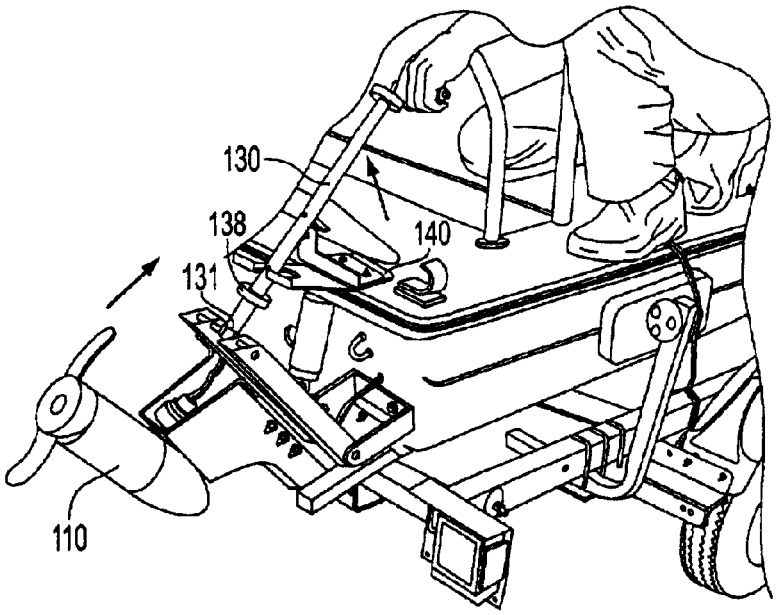
FIGS. 8 and 9 illustrate positioning of the system in a stowed position.
Figure 9:
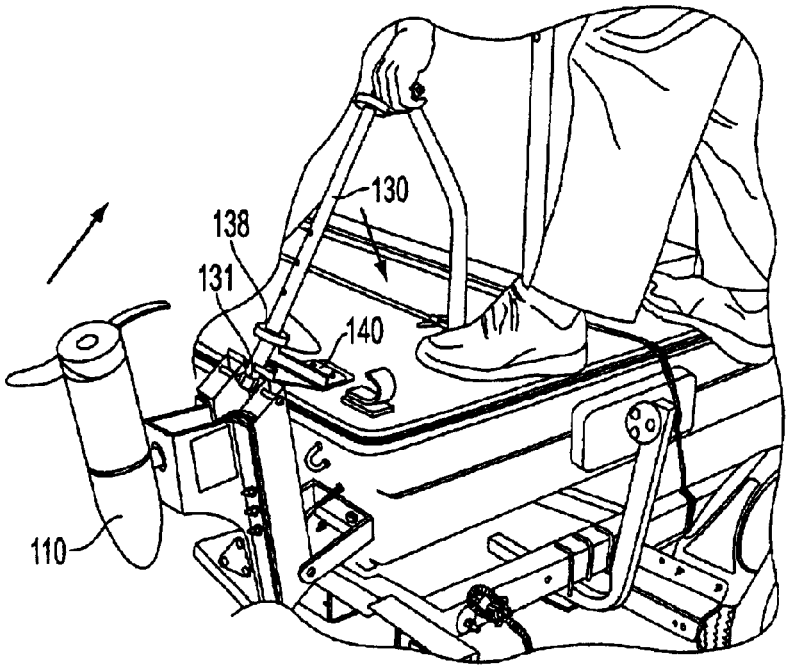

As shown in FIG. 1, the motor 110 is in a lower position and is substantially horizontal. It should be appreciated, however, that other angular positions can be accommodated by adjusting positioning handle 130 (for example, by telescoping positioning handle 130 as earlier described). When it is desired to lift the trolling motor, as shown in FIG. 8, positioning handle 130 may be pulled in a direction along its longitudinal axis opposite to its pivot end 131 in order to release positioning handle 130 from retention surfaces 142. Handle 130 may then be outwardly rotated through groove 141 and then pulled in a continuing direction opposite to the pivot end 131 until the motor 110 is in an upright facing position as shown in FIG. 9. When the trolling motor 110 reaches the upward facing position, handle 130 may be rotated inwardly and released so that lower disk 138 affixed to positioning handle 130 near pivot end 131 is retained by retaining bracket 140.

Figure 10:
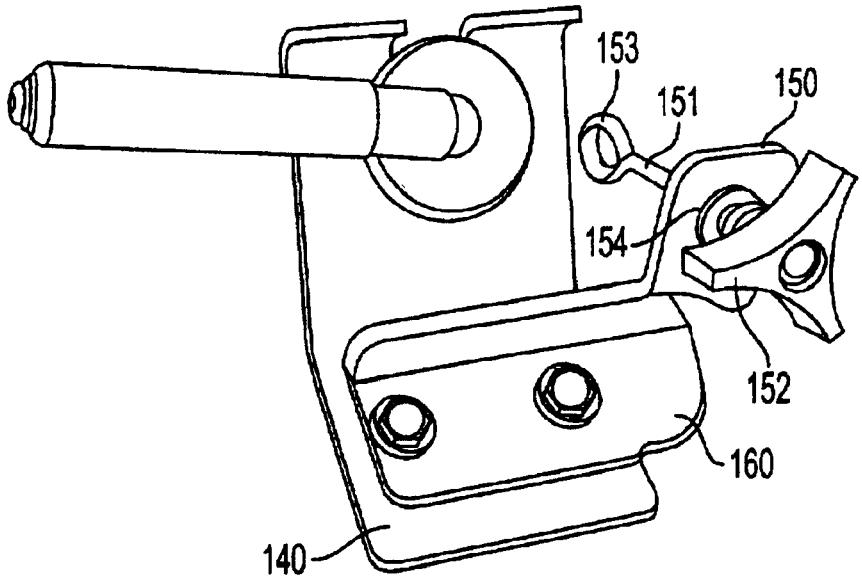
FIGS. 10–12 illustrate a first embodiment of a locking mechanism used for the stowed position.
Figure 11:
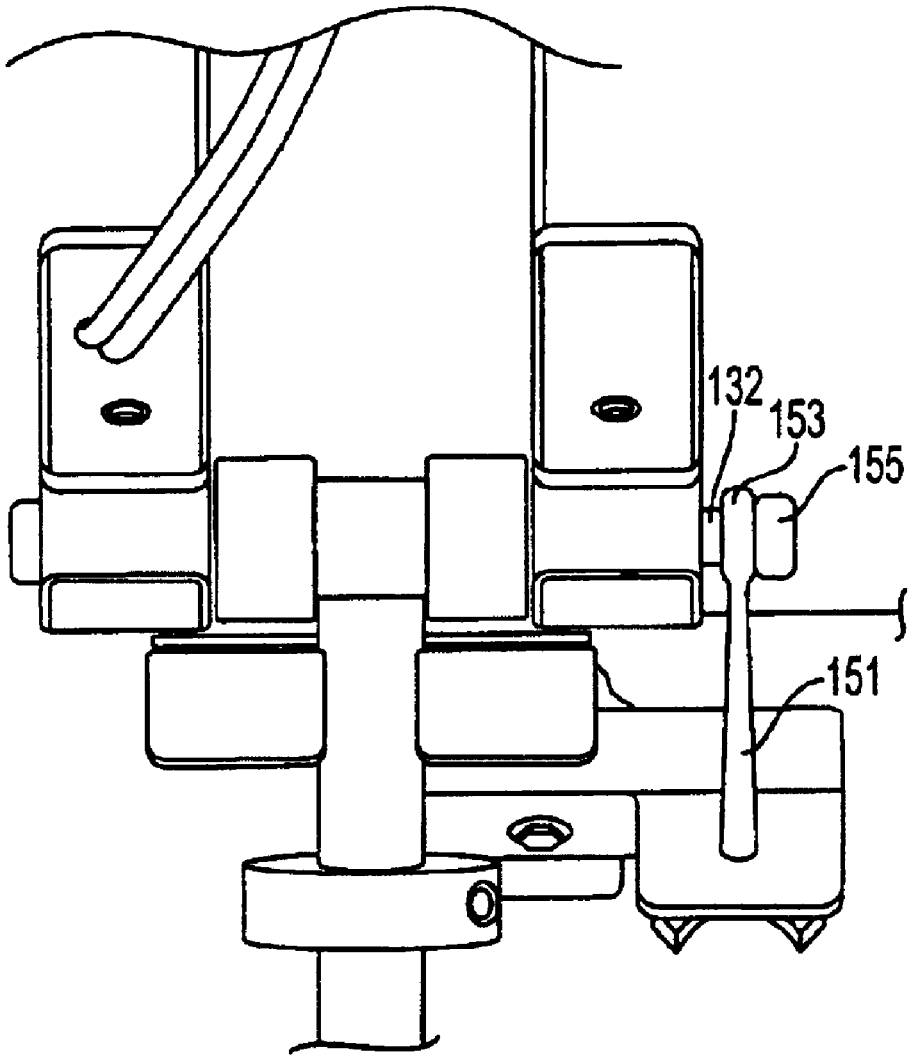

As shown in FIG. 10, a locking mechanism 150 is secured at one end to retaining bracket 140 (for example, by means of bracket 160). A loop portion 153 of eye-bolt 151 of locking mechanism 150 as shown in FIG. 1 may be placed over a retaining head 155 of axle 132. Tightening nut 152 as shown in FIG. 10 may then be applied to eye-bolt 151 and tightened against tightening surface 154 in order to secure motor 110 in an upward facing position. In addition, the telescoping portion of positioning handle 130 may be collapsed in order to provide easier stowage.

Once the motor is secured to the boat, and to further secure the entire trolling motor assembly as shown in FIG. 12, positioning handle 130 may be outwardly rotated from retaining bracket 140 make contact with motor 110 (typically at or near propeller 111). Various means may be used to further secure positioning handle 130 to the motor 110. For example, an elastic cord 156 may be stretched and wrapped around positioning handle 130 and then secured at various apertures in bridge piece 125.

Figure 13:
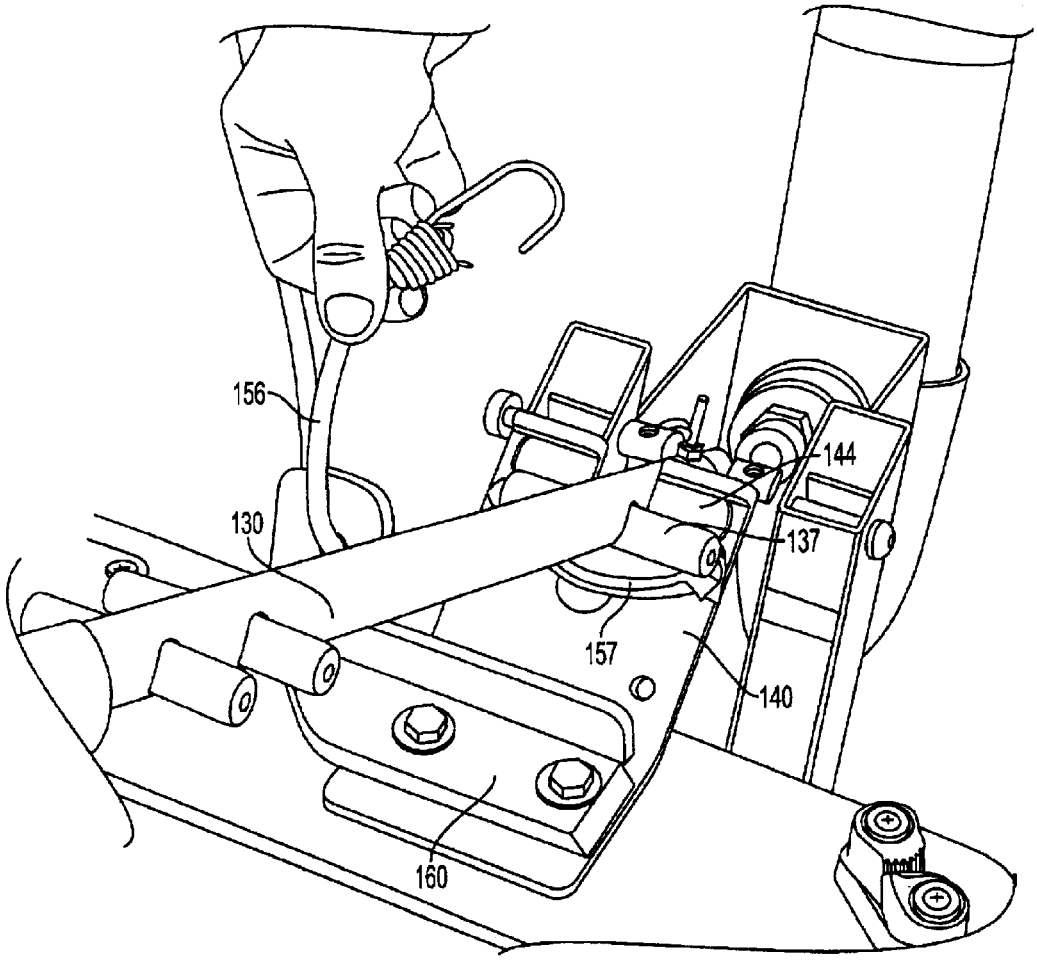
FIGS. 13 and 14 illustrate a second embodiment of the locking mechanism.
Figure 14:
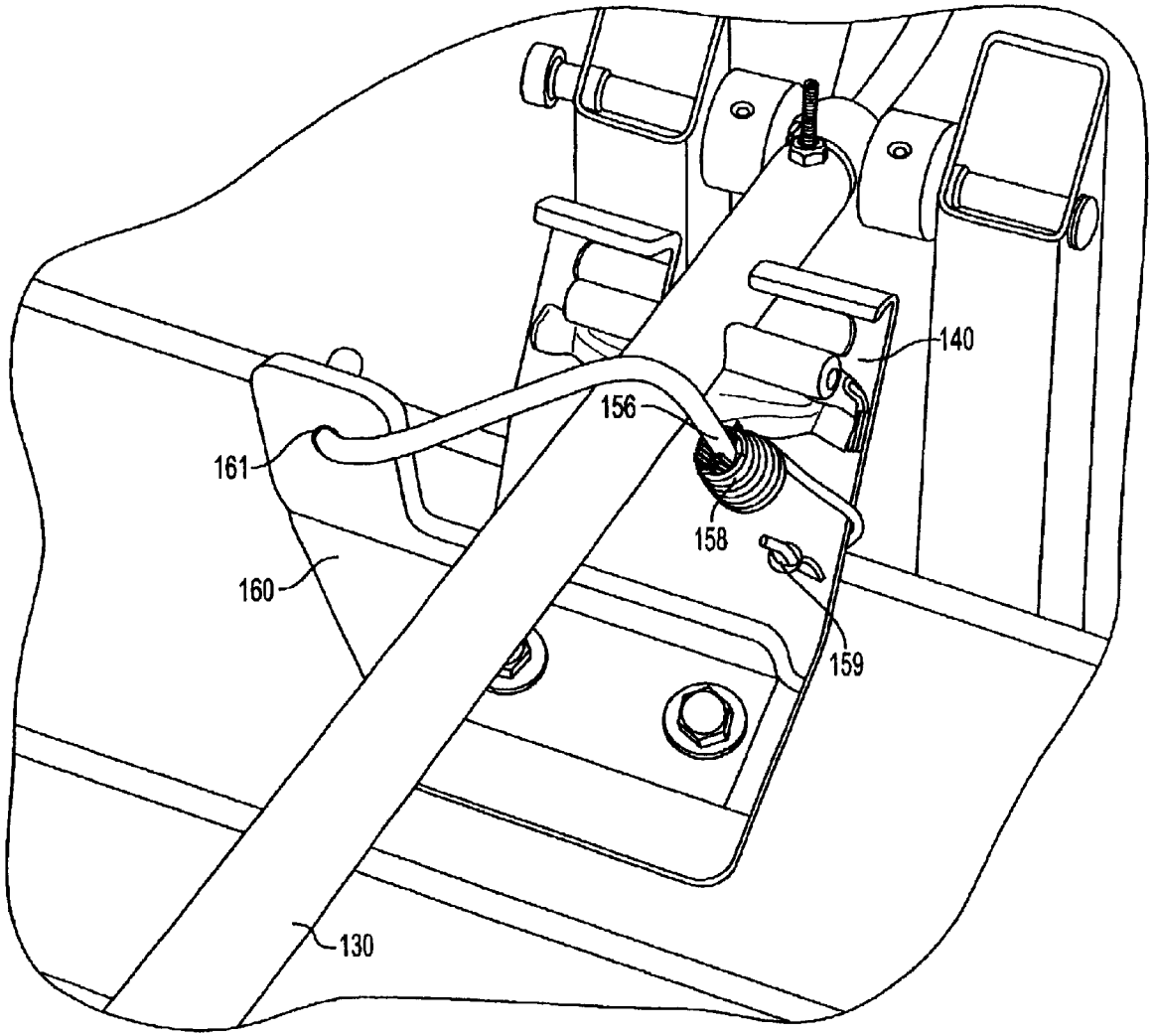

Alternatively, as shown in FIGS. 13 and 14, motor 110 may be stowed with a lower pin 137 in positioning handle 130 secured in retaining bracket 140 by means of elastic cord 156. As shown in FIG. 14, elastic cord 156 may be secured to an aperture 161, and then stretched and wrapped around positioning handle 130 to be securely attached to an aperture 159 in positioning bracket 140 by means of a hook 158. A cushioning brace 157 is fixedly attached across groove 141 of retaining bracket 140 in order to receive and provide a compliant stop for positioning handle 130 as it is secured by elastic cord 156.

Figure 15:
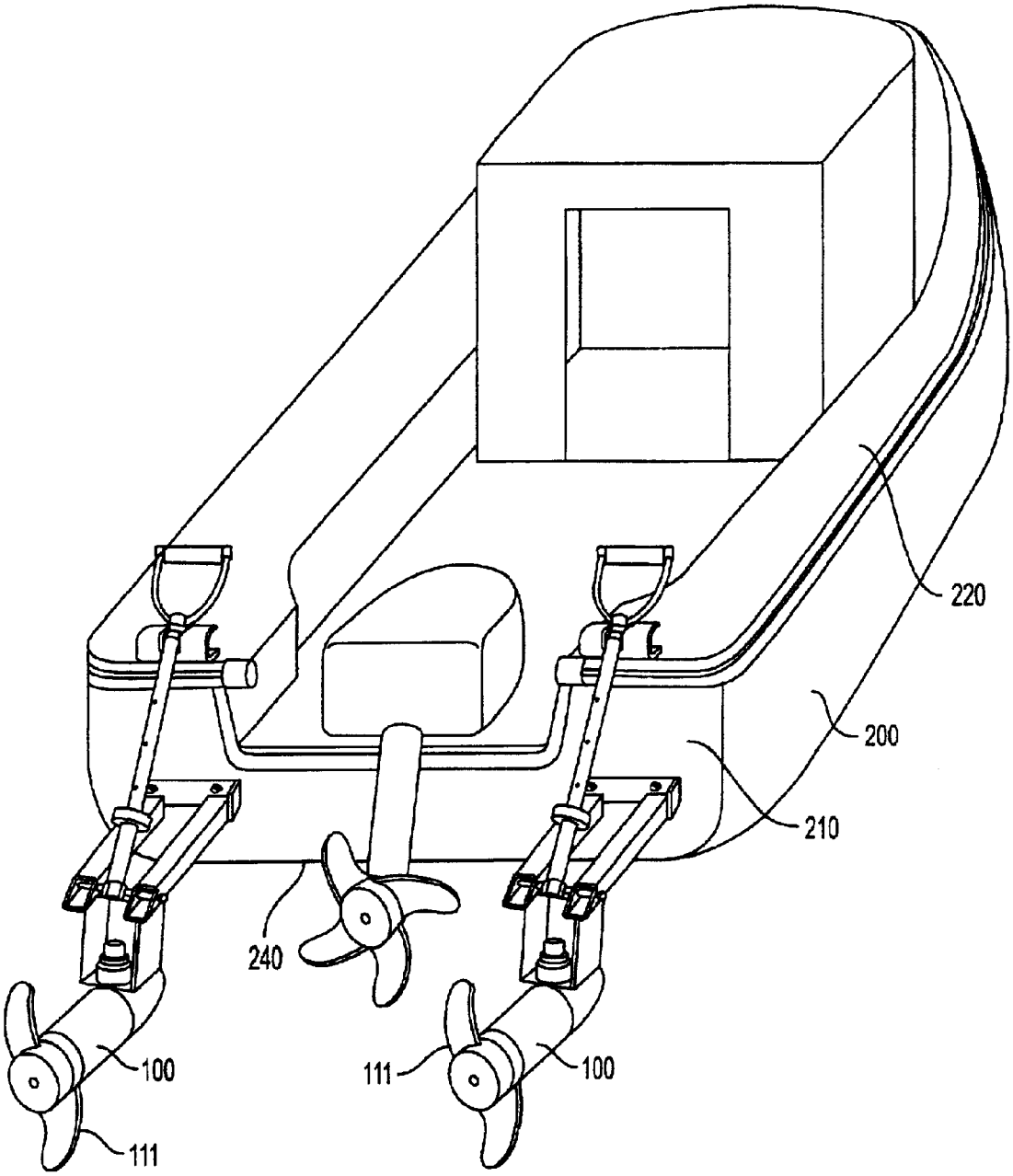
FIG. 15 illustrates a fourth preferred embodiment of the present invention, employing two propulsion apparatus for propelling and steering a boat.

As earlier mentioned, and as shown in FIG. 15, a preferred embodiment of the present invention includes two propulsion apparatus 100, each mounted at lateral edges of transom 210. Motors 110 associated with each of the propulsion apparatus 100 are preferably at least 24 inches rearward of transom 210, and further positioned so that propellers 111 are fully above a bottommost edge 240 of transom 210. In this manner, propellers 11 remain free to operate when boat 200 is bottomed at bottommost edge 240. With a separate propulsion device at each edge of transom 210, motors 110 can be individually varied in rotational speed and direction in order to maneuver the boat 200. Although FIG. 15 illustrates a preferred embodiment of the invention, various other configurations and positionings of one or more propulsion apparatus 100 in relation to the boat 200 are contemplated within the scope of the invention.

Figure 16:
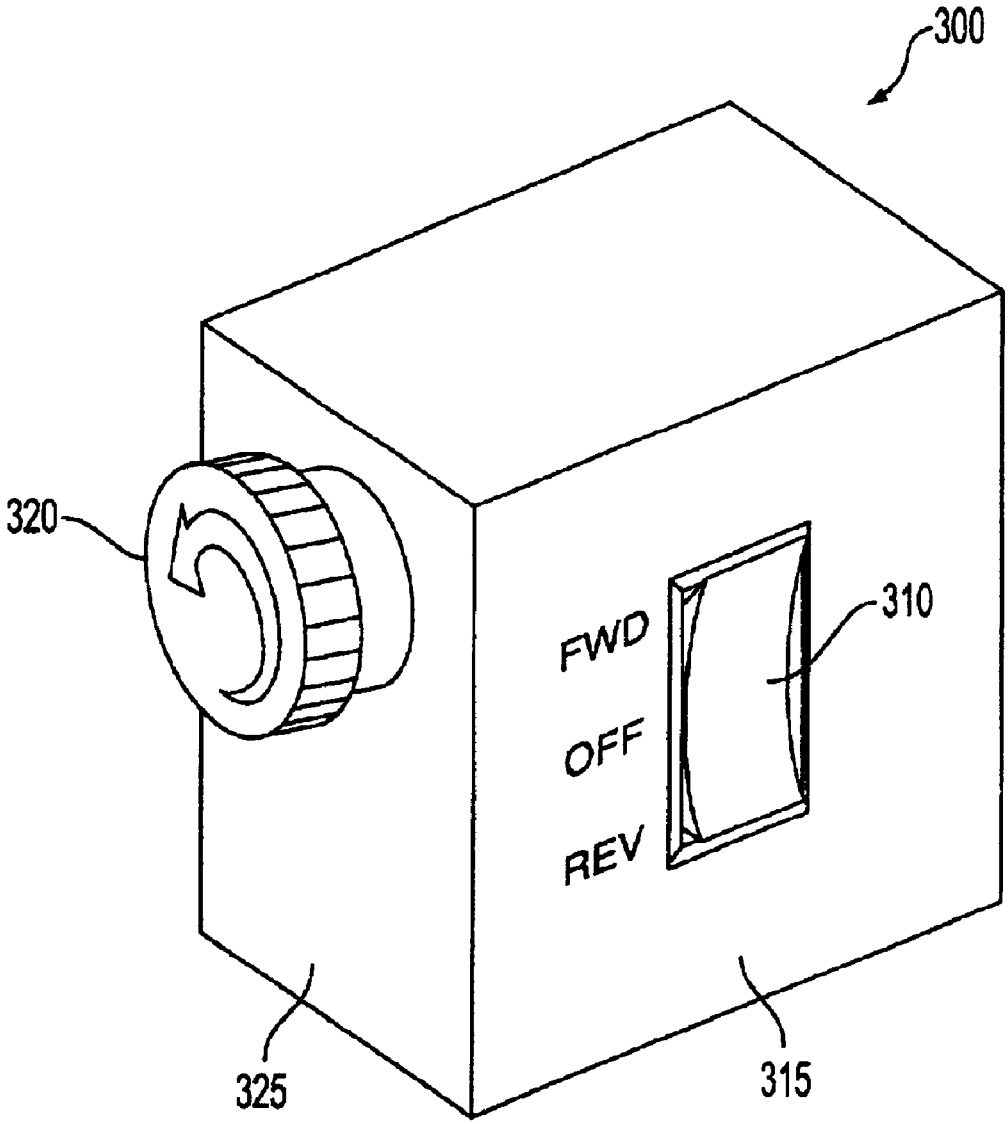
FIGS. 16–19 illustrate a control unit used in conjunction with the preferred embodiment of FIG. 15.

As illustrated in FIG. 16, each motor 110 is typically controlled by a motor control 300 (for example, as manufactured by Minn Kota of Mankato, Minn.). Motor control 300 may be produced in a variety of configurations. By way of example, and as shown in FIG. 16, motor control 300 includes a switch 310 which directs forward and reverse movements and also provides a stopped position. Motor control 300 also includes a variable control knob 320 that may be rotated in one direction for increasing the speed and in the opposite direction for decreasing the speed. The speed control provided by knob 320 is preferably continuous so that slight variations in speed may be achieved.

Figure 18:
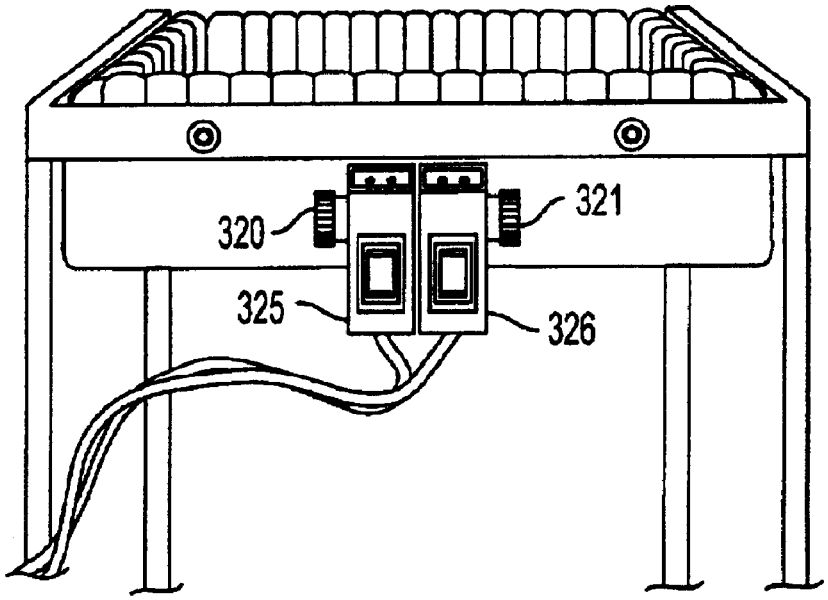

As required by the preferred embodiment of FIG. 15, two motors 110 are controlled to propel and maneuver the boat 200. For ease of operation, two motor controls 300 can be placed adjacent to each other and secured together (for example, as shown in FIG. 18). In the configuration of FIG. 18, variable control knobs 320, 325 are located on opposing side faces 325, 326. The direction of control for with control knob 325 is inverted from the direction of control for control knob 320, so that a user will intuitively operate opposing control knobs 320, 321 in one apparent direction to obtain a similar response from each motor 110. As a result, the user may be relieved form thinking about which motor operates in which direction.

Figure 17:
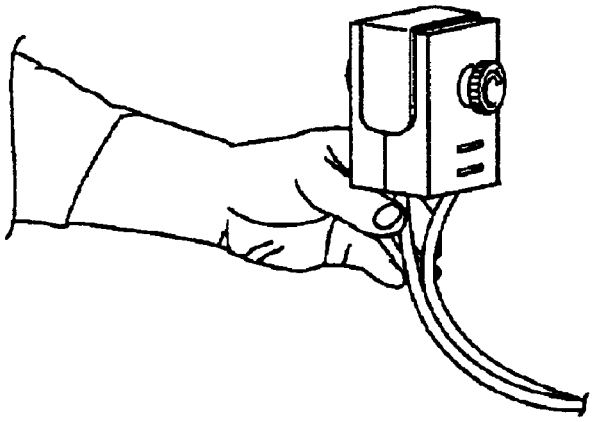
Figure 19:
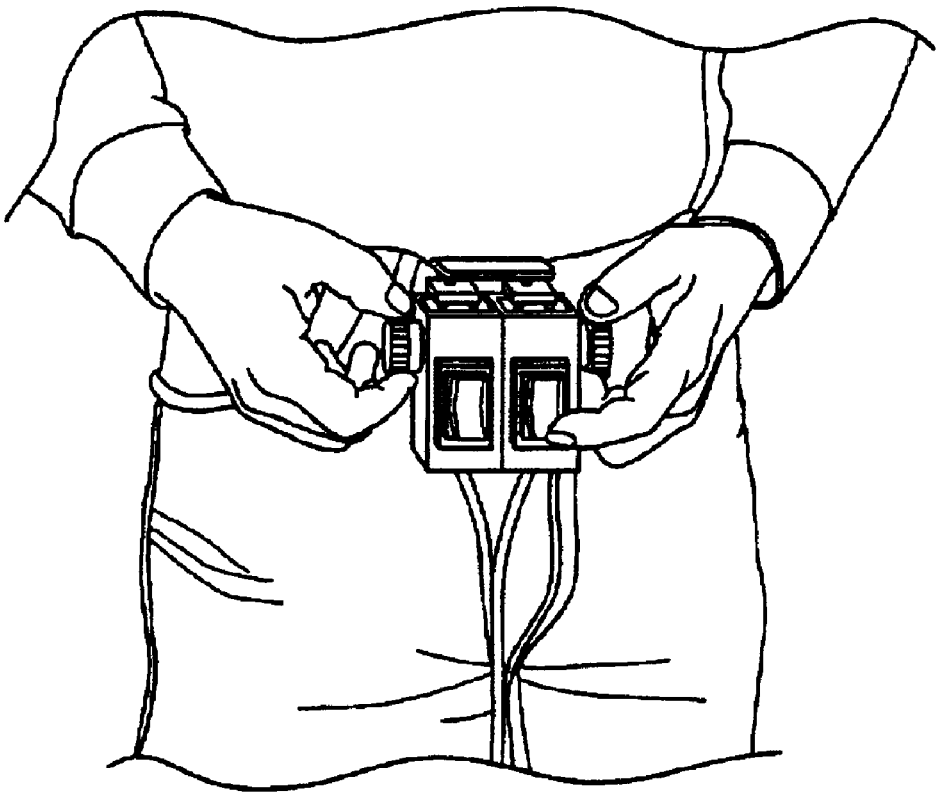

As shown in FIG. 17, motor controls 300 may be attached to a belt clip for easy attachment to the belt of a user as shown in FIG. 19. Alternately, the motor control unit can likewise be attached to any standing cage or retention device as shown in FIG. 18. It should be noted that the motor control can be held in any of a variety of other positions as desired.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A propulsion apparatus for use with a boat, the apparatus comprising:

a motor;

a primary bracket assembly having proximal and distal ends; said primary bracket assembly being non-pivotally attached to said motor near the distal end and pivotally attached to the boat at the proximal end;

a retaining bracket, said retaining bracket being fixedly attached to the boat; and a positioning handle, said positioning handle being pivotally attached near the distal end of said primary bracket assembly to be adjustably positioned in said retaining bracket to set a desired operating position for the motor, the primary bracket assembly being thereby adjustable such that the desired operating position may be set to assume one of a range of angular positions of the motor;

wherein the positioning handle includes a grip for manually adjusting the position of the positioning handle in said retaining bracket.

2. The propulsion apparatus of claim 1, wherein said positioning handle telescopes to establish said desired operating position.

3. The propulsion apparatus of claim 1, wherein said positioning handle has one or more retainers for holding by said retaining bracket.

4. The propulsion apparatus of claim 3, wherein said one or more retainers are pins each perpendicularly mounted in an aperture in said positioning handle.

5. The propulsion apparatus of claim 1, wherein said desired operating position is achieved when a centerline of the primary bracket assembly and a centerline of the positioning handle form an angle of approximately forty-five degrees.

6. The propulsion apparatus of claim 1, wherein said positioning handle may be further adjustably positioned to achieve a stowed position.

7. The propulsion apparatus of claim 6, wherein said retaining bracket further includes a securing mechanism for securing the propulsion apparatus in its stowed position.

8. The propulsion apparatus of claim 1, wherein said desired operating position places a rear surface of a propeller of the motor at least two feet behind a rear transom surface of the boat.

9. The propulsion apparatus of claim 1, wherein said desired operating position places a lower edge of a propeller of the motor above a bottom edge of a hull surface of the boat.

10. The propulsion apparatus of claim 1, wherein the desired operating position defines a horizontal centerline through the motor that is substantially parallel to a direction of horizontal travel of the boat.

11. The propulsion apparatus of claim 10, wherein the horizontal centerline of the motor extends distally slightly downward from the direction of horizontal travel of the boat.

12. The propulsion apparatus of claim 10, wherein the horizontal centerline of the motor extends distally slightly upward from the direction of horizontal travel of the boat.

13. A propulsion apparatus for use with a boat, the apparatus comprising:

a motor;

a primary bracket assembly having proximal and distal ends; said primary bracket assembly being fixedly attached to said motor near the distal end and pivotally attached to the boat at the proximal end;

a retaining bracket, said retaining bracket being fixedly attached to the boat; and a positioning handle, said positioning handle being pivotally attached near the distal end of said primary bracket assembly to be adjustably positioned in said retaining bracket to achieve a desired operating position for the motor;

wherein the positioning handle includes a grip for manually adjusting the position of the positioning handle in said retaining bracket and has one or more retainers for holding by said retaining bracket, wherein said one or more retainers are disks each co-axially affixed to said positioning handle.

14. A propulsion apparatus for use with a boat, the apparatus comprising:

a motor;

a primary bracket assembly having proximal and distal ends; said primary bracket assembly being fixedly attached to said motor near the distal end and pivotally attached to the boat at the proximal end;

a retaining bracket, said retaining bracket being fixedly attached to the boat; and a positioning handle, said positioning handle being pivotally attached near the distal end of said primary bracket assembly to be adjustably positioned in said retaining bracket to achieve a desired operating position for the motor;

wherein the positioning handle includes a grip for manually adjusting the position of the positioning handle in said retaining bracket and may be adjustably positioned to achieve a stowed position, and wherein said retaining bracket further includes a securing mechanism for securing the propulsion apparatus in its stowed position, the securing mechanism including an elastic cord having one end fixedly attached near the retaining bracket.

15. A propulsion apparatus for use with a boat, the apparatus comprising:

a motor;

a primary bracket assembly having proximal and distal ends; said primary bracket assembly being fixedly attached to said motor near the distal end and pivotally attached to the boat at the proximal end;

a retaining bracket, said retaining bracket being fixedly attached to the boat; and a positioning handle, said positioning handle being pivotally attached near the distal end of said primary bracket assembly to be adjustably positioned in said retaining bracket to achieve a desired operating position for the motor;

wherein the positioning handle includes a grip for manually adjusting the position of the positioning handle in said retaining bracket, and wherein the primary bracket assembly further comprises a deflection plate positioned above the motor.

16. The propulsion apparatus of claim 15, wherein an area defined by the deflection plate exceeds an area projected onto the deflection plate by a volume traced by a propeller of the motor through its rotation.

17. A boat having a propulsion apparatus, the propulsion apparatus comprising:

a motor;

a primary bracket assembly having proximal and distal ends; said primary bracket assembly being non-pivotally attached to said motor near the distal end and pivotally attached to the boat at the proximal end;

a retaining bracket, said retaining bracket being fixedly attached to the boat; and a positioning handle, said positioning handle being pivotally attached near the distal end of said primary bracket assembly and adjustably positioned in said retaining bracket to set a desired operating position for the propulsion motor, the primary bracket assembly being thereby adjustable such that the desired operating position may be set to assume one of a range of angular positions of the motor;

wherein the positioning handle includes a grip operable from the boat for manually adjusting the position of the positioning handle in said retaining bracket.

18. The boat of claim 17, having at least two propulsion apparatus, wherein each of two said at least two propulsion apparatus are positioned near a lateral edge of a transom of the boat.

19. The boat of claim 18, wherein the direction of travel of the boat may be selectively steered by adjusting a speed and a direction of propeller rotation for each of the two laterally positioned propulsion apparatus.

20. The boat of claim 19, further comprising a control unit for selecting the speed and direction of propeller rotation for each of the two laterally positioned propulsion apparatus.

21. The boat of claim 20, wherein the control unit is mounted in a position remote to each of the two laterally positioned propulsion apparatus.

22. The boat of claim 21, wherein the control unit further has a belt-mounting clip.

23. The boat of claim 20, wherein the control unit provides a continuous speed adjustment for selecting the speed.

24. The boat of claim 20, wherein the control unit can be manipulated to provide a stopped position of the boat.

* * * * *